US005503089A

United States Patent [19]

Frontini et al.

[11] Patent Number: 5,503,089

[45] Date of Patent: Apr. 2, 1996

[54] ARRANGEMENT FOR HOT KILLING THE ACIDS CONTAINED IN FLUE GASES FROM WASTE DISPOSAL PLANTS, POWER PLANTS, AND INDUSTRIAL PRODUCTION PLANTS

[75] Inventors: Luis E. Frontini, Genova; Maria L. Pelizza, Alessandria; Francesco Repetto, Genova, all of Italy

[73] Assignee: Finmeccanica S.p.A. - Azienda Ansaldo, Genova, Italy

[21] Appl. No.: 171,092

[22] Filed: Dec. 21, 1993

[51] Int. Cl.[6] ..... F23N 5/00

[52] U.S. Cl. ..... 110/185; 110/215; 110/345

[58] Field of Search ..... 110/187, 188, 110/210, 211, 212, 215, 266, 343, 345, 185

[56] References Cited

U.S. PATENT DOCUMENTS

| | | | |
|---|---|---|---|
| 4,722,287 | 2/1988 | Anderson et al. | 110/345 X |
| 4,873,930 | 10/1989 | Egense et al. | 110/343 X |
| 5,185,134 | 2/1993 | Gullett | 110/345 X |

*Primary Examiner*—Denise L. Gromada
*Assistant Examiner*—Susanne C. Tinker
*Attorney, Agent, or Firm*—Morgan & Finnegan

[57] ABSTRACT

An arrangement for hot killing the acid contents of flue and process gases comprising a burner for discharging fuel and combustion supporter, preferably Diesel oil, fuel oil and air, to a combustion chamber, to produce a flame and gas burnt, and means of injecting/blowing a basic substance in either powder or solution form into a hot region of the flame, the gas burnt thus enriched with basic substance being mixed with the flue gas and hot killing its acid contents.

3 Claims, 4 Drawing Sheets

ARRANGEMENT FOR HOT KILLING THE ACIDS CONTAINED IN FLUE GASES FROM WASTE DISPOSAL PLANTS, POWER PLANTS, AND INDUSTRIAL PRODUCTION PLANTS

FIELD OF THE INVENTION

This invention relates to an arrangement for hot killing the acid contents of flue gases or process gases as respectively released by waste incinerating plants, power plants, and industrial process plants, as well as to a related killing burner and method.

BACKGROUND OF THE INVENTION

It is recognized that a crucial problem of today's industrial communities is the disposal of solid urban waste (RSU), acid flue gases from thermoelectric power plants burning fuels which have a significant sulphur content, and harmful toxic waste (RTN) from industrial processes, which can neither be released into the environment nor stored at dumping sites, on account of their very low biodegradability and/or toxic nature.

The extensive use of plastics, synthetic rubbers, industrially made paints and dyes, and composite materials has made this problem a dramatic one and dictated recourse to means of breaking down the molecular structures of such materials, mainly by heat application/combustion, and of reducing the materials to elemental substances having simple molecular structures.

The process is carried out in incinerating plants where the heterogeneity of the mostly combustible materials to be incinerated is utilized to feed a first combustion carried out with an external fuel contribution which results in the flue gas attaining temperatures on the order of upwards of 950° C., thereby ensuring decomposition of the volatiles and powders contained in the flue gas.

The heat generated by the combustion process is preferably recovered through steam-generating boilers and exchangers, and distributed to users of various kinds.

Flue gases cannot, however, be exhausted to the atmosphere uncontrollably because they contain significant amounts of such acid BO substances as HC1, HF and SO2.

A similar problem is encountered with thermoelectric power plants, wherein the use of such fuels as coal, lignites, and hydrocarbons which may contain sulphur in non-negligible amounts results in acid flue gases being released which are high in SO2 content.

It is therefore mandatory that the acid substances contained in the flue gas be killed before the latter is exhausted to the atmosphere.

The killing is accomplished on bulky and expensive scrubbing towers.

Due to the low operating temperatures (<100° C.), these represent the last component before the chimney, so that the whole system is swept by flue gas laden with acid substances, with attendant serious corrosion effects especially on the tube nest of the boiler.

The scrubbing waters, moreover, require to be processed for separation of the acid substances to prevent these from being passed into the environment, in the instance of scrub water open-flow systems, or for saturating the scrubbing liquids, in the instance of closed-circuit systems.

This process is the more expensive and the involved equipment the bulklet, the higher is the flow-rate of the flue gases being handled.

Thus, conventional incinerating plants and thermoelectric power plants are high in volume and cost, and liable to rapid deterioration, whereby additionally to involving continued careful maintenance work, they require frequent overhauling.

The latter can only be carried out, of course, with the system shut down and cold, which involves prolonged off-duty during which time, if a build-up of the waste material is to be avoided, this must be re-directed to backup plants at added transport costs, or multiple incinerating plants must be provided which can be shut off in turns.

SUMMARY OF THE INVENTION

Such drawbacks are to a large extent corrected by the inventive arrangement for hot killing of the acid contents of flue gases, which provides for killing the acid substances already from the post-combustion stage while the flue gas is at its highest temperature, that is upstream of the regenerative boiler and the other plant components, such as electrostatic filters and scrubbing towers.

The advantages to be derived are the following:

- lowered acid substance content of the flue gas exhausted to the atmosphere, by virtue of the killing reaction being more efficient and mainly carried out while in a hot state (at the post-combustion stage in incenerating furnaces) and continuously all along the flowpath of the flue gas, as against the conventional killing reaction which takes place at the scrubbing towers and, therefore, in a cold state, and within a limited section of the flue gas flowpath,
- improved thermal yield from the plant cycle, for generating electric power or recovering heat, because all of the flue gas enthalpy can be used which was not utilized heretofore to avoid operating at temperatures which would promote wet corrosive action of the acids,
- reduced dry and wet corrosion phenomena, for both the regenerative boiler and the other systems located downstream therefrom,
- reduced size of the scrubbing towers, which can be sized for just killing residual acid substances,
- possible use, as basic substances, of readily available mineral salts, such as lime, calcium, magnesium, and sodium carbonates and bicarbonates, including soluble substances, as the basic substances.

According to the invention, these advantages are offered by an arrangement which uses a burner to generate flue gas from the reaction of a fuel with a combustion supporter, with attendant production of a flame in a combustion chamber, and means of discharging a basic substance, either in powder or solution form, into a definite hot spot of the flame, the gas burnt thus enriched with basic substance which is at least partially vaporized, becoming mixed with the flue gas or process gas and neutralizing the acid substances contained therein.

According to a further aspect of the present invention a particular kind of basic burner or combustor, operating at very high temperature, is used.

The combustor forms a combustion flame confining chamber which is communicated with the post combustion chamber of the incinerating/thermal plant, by a convergent accelerating nozzle.

The basic combustor is operated at higher pressure relative to the post combustion chamber, whereby the pressure of the high temperature gas issuing from the confining chamber and entering the post combustion chamber is converted to kinetic energy to originate a jet of high speed gas which penetrates deeply into the flue gas and becomes blended therewith by turbulent motion.

Thus the killing reaction is uniformly distributed throughout the flue gas volume even in case of very large post combustion chambers.

DESCRIPTION OF THE DRAWINGS

The features and advantages of the invention will become more clearly apparent from the following description of a preferred embodiment thereof and the accompanying drawings, in which.

DETAILED DESCRIPTIONS OF THE PREFERRED EMBODIMENTS

Figure 1:
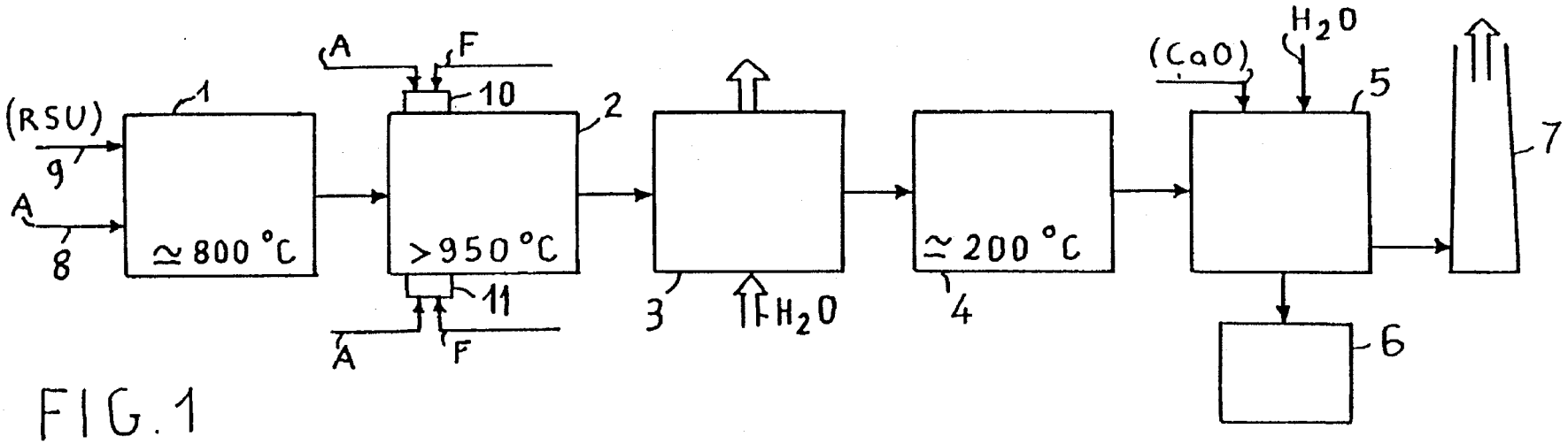
FIG. 1 shows, in block diagram form, a prior art incinerating plant.

For a better understanding of the invention, FIG. 1 shows schematically, in block diagram form, a prior art incinerating plant comprising a combustion chamber 1, post-combustion chamber 2, regenerative boiler 3, set of electrostatic filters 4, scrubbing tower 5 and associated treatment system for waste waters 6, and chimney 7 for exhausting flue gases to the atmosphere.

The chamber 1 is supplied an air stream 8 and solid urban waste (RSU) 9 which is burned to bring the chamber temperature to about 800° C.

The solid residue, which mainly consists of inert slag, is either disposed of to dumping sites or treated for recovery through the possible use of selective processes.

The flue gas laden with considerable amounts of vapors and unburnt, is passed into the post-combustion chamber 2, to which a plurality of burners 10, 11 deliver air A and fuel F (usually a gas or Diesel oil) in a suitable ratio which on burning, will bring the flue gas temperature to above 950° C., thereby causing dissociation of the vapors and particulate and formation of elemental substances, anhydrides and acids, which are to a large extent ionized and particularly active.

The hot flue gas will sweep through a regenerative boiler 3 to transfer some of its heat contents to an exchange fluid, usually water, which will be brought to a vapor state.

By this exchange of heat, the temperature of the flue gas is brought to values close to but not lower than 200° C., to avoid steam condensation phenomena which would boost the corrosive action of the flue gas.

The flue gas is then flowed through electrostatic filters 4, where the powdered solids and the ions contained therein are preliminarly trapped, and thereafter through a scrubbing tower 5 which is supplied with water and soluble basic substances, usually powdered quicklime (CaO) or calcium hydroxide (Ca(OH)2).

The acid substances contained in the flue gas and its condensates are dissolved in the scrubbing water and reacted with the basic substances dissolved therein to form salts.

In this way, the acid substances are trapped, in a substantially cold state and aqueous phase, the process requiring subsequent treatment of the scrubbing waters in systems 6 for precipitating and separating the salts dissolved in them.

The purified flue gas, including an acceptable acid substance residue, is then exhausted to the atmosphere through a chimney 7.

It may be appreciated from the foregoing that the acid substance killing process is carried out primarily within the scrubbing tower 5, and that the boiler 3 and electrostatic filters 4 are exposed to the corrosive attack from the acid substances, which is bound to take place not only in the wet state but also, to some extent, in the dry state.

Furthermore, to prevent condensation phenomena, and attendant wet corrosive attack, the temperature of the flue gas issuing from the boiler area and entering the filters 4 should be no lower than 200° C., which entails considerable waste of heat contents.

Finally, the killing of the acid substances is effected substantially in a cold state, and aqueous phase, that is with limited efficiency and a need for soluble basic substances as reactants, such as calcium oxide, which would then be hydrated, or lime milk.

Figure 2:
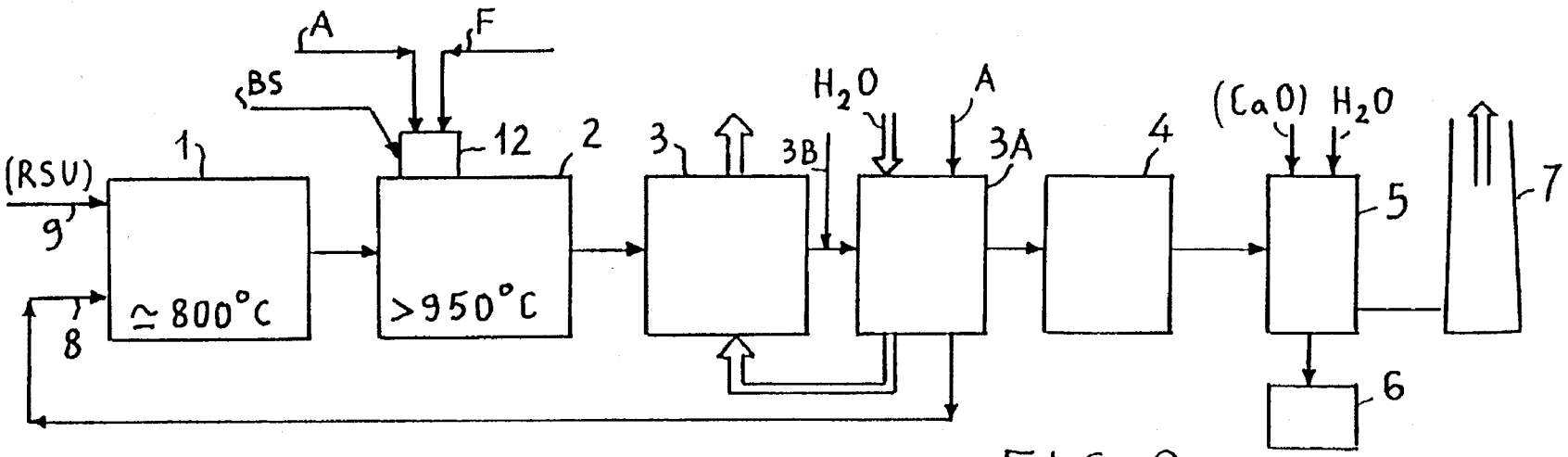
FIG. 2 shows schematically, in block diagram form, an incinerating plant with an arrangement for hot killing the acid contents of flue gases according to this invention.

FIG. 2 shows a block diagram of a waste incinerating plant with an arrangement for hot trapping the acid contents of flue gases, embodying this invention, and a comparison of this with FIG. 1 will clearly bring out the innovative features of the arrangement.

In FIG. 2, the hot flue gas (primary gas) leaving the combustion chamber 1, identical with the chamber 1 in FIG. 1, is passed into a post-combustion chamber 2.

The post-combustion chamber 2 is also fed, additionally to the primary gas, a secondary gas from one or more burners, of which only one is shown at 12.

Figure 3:
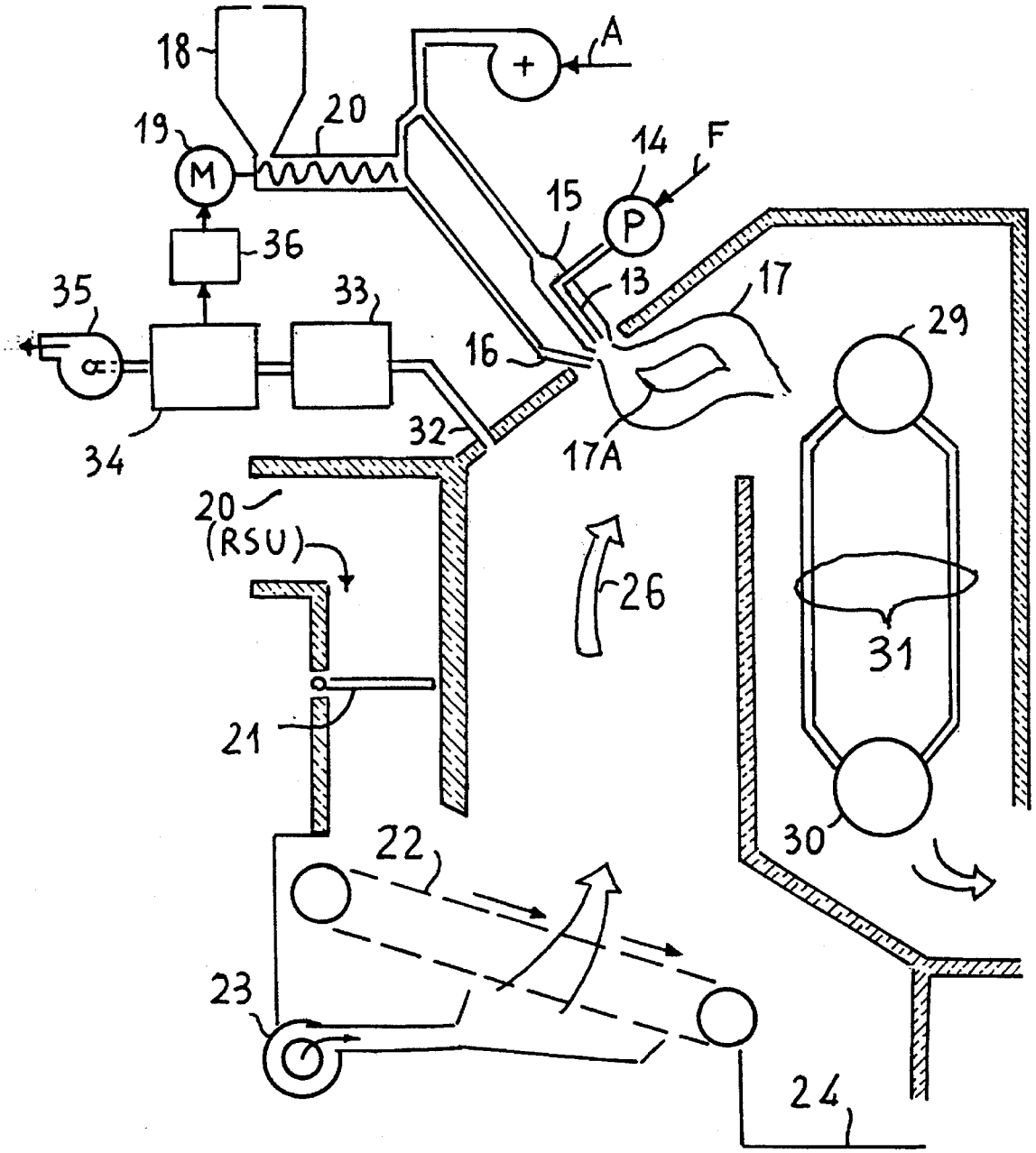
FIG. 3 shows schematically a cross-section through an incinerating furnace for the plant in FIG. 2.

Unlike ordinary burners, the burner 12, as more clearly shown in FIG. 3, is not only provided with a conventional means of discharging a fuel F (e.g. a liquid fuel atomizer 13, for fuel oil or Diesel oil) to be fed from a variable pressure/flow rate pump 14 and means (nozzle 15) of discharging a combustion gas A, usually compressed or blown air, but also with means of discharging a basic substance (BS), generally consisting of a blow or injection nozzle 16 suitably oriented to convey the basic substance to a hot region 17A of the flame 17 issuing from the burner.

In one embodiment form, the killing arrangement, which may be regarded as a dry operated one, the powdered basic substance, stored in a storage reservoir 18, is conveyed to the nozzle 16 by an auger 20 driven by a motor 19.

The nozzle 16 is also supplied an entrainment gas, such as compressed air, which will blow the basic powder toward the flame 17, thereby preventing the nozzle 16 from becoming clogged and imparting appropriate velocity to the powder issuing from the nozzle.

The powdered basic substance may conveniently be a mineral compounds such as CaCO3, MgCO3, CaMg(CO3)2 in powder form, or calcium oxide CaO.

The comparatively high temperature, on the order of 1600 to 1800° C., of the flame makes the basic powder particularly active, due also to decomposition of the mineral and formation of largely ionized alkaline oxides.

The powder, thus activated, is caused to contact by turbulence, while in a hot state, the acid component of the flue gas, causing it to become neutralized and form neutral salts.

In a second embodiment form of the killing arrangement, which may be regarded as a wet operated one, the soluble basic substance dissolved in water, as optionally heated for enhanced solubility, is discharged into the nozzle 16, an injector in this case, from a flow-rate controlling feed pump instead of an auger.

In this case, the basic substance may conveniently be lime milk, sodium carbonate or bicarbonate, or another soluble basic substance which can yield ions of alkaline or alkaline-earth metals.

The high temperature of the flame causes the solution to be vaporized and the basic substance dissolved therein to be activated and become largely ionized to then neutralize the acid flue gas by becoming mixed therewith.

The salification reaction is particularly fast within the limitations of the reaction balance at the high temperature of the flue gas, which may exceed 900° C.

As a result, as the flue gas sweeps past the tube nest of the regenerative boiler, its corrosive action is greatly attenuated, if not altogether suppressed, and tapers out as temperature goes down, thereby avoiding the formation of acid condensates.

Consequently, the heat recovery process can be carried out much more efficiently by providing, in the flue gas flowpath as shown in FIG. 2, a regenerative boiler 3 followed by a pre-heater exchanger 3A for the boiler feed water and/or the combustion air being supplied to the plant.

The flue gas, which may be cooled to a temperature below 100° C., is then flowed through dust-collecting electrostatic filters 4, wherein the salts from the acid contents trapping reaction are to a large extent deposited, and thence through a scrubbing tower 5 which, inasmuch as the acid substances have been largely, if not completely, trapped ahead of it, can have greatly reduced capacity, and in the extreme may be omitted altogether, as omitted may be the addition of basic substances in the cold state and the scrubbing waters treatment.

For example, in order to kill the residual acidity, it would be possible, as shown in FIG. 2, to input additional basic substance, in powder or acqueous solution form, at an intermediate zone of the warm flue gas stream, for istance between regenerative boiler 3 and pre-heater exchanger 3A.

The additional basic substance may be input through a duct 3B, possibly with controlled flow rate, depending on measured residual acidity.

It will be appreciated that the block diagram of FIGS. 1 and 2 is purely illustrative of the overall concept and that no definite separation exists between the combustion chamber, the post-combustion chamber, and the regenerative boiler, all of which would be integrated to a unitary structure, as shown schematically in FIG. 3.

In FIG. 3, solid urban waste RSU is loaded into the furnace through a discharge port 20 and dropped, as allowed for by periodically operating a control gate 21, onto a movable feed grate 22 through which combustion air is supplied to the furnace from a fan 23.

The combustion cinder is collected into a pit 24.

A suitably insulated combustion chamber is formed upwardly of the grate 22, whose bottom portion forms the combustion chamber proper and top portion forms the aforesaid post-combustion chamber.

One or more burners of the kind previously described, of which one is shown in section to an enlarged scale with respect to the remainder of the plant, deliver the basic substance into the post-combustion chamber at the flame 17.

The flame burnt 17, as additivated with basic substance, becomes mixed with the primary gas 26, thereby trapping its acid contents.

The mixed flue gas then flows countercurrently through a regenerative boiler (illustrated by two cylindrical bodies 29, 30 interconnected by a tube nest 31) and the cooled flue gas leaves the regenerative boiler and is discharged, with the possible assistance of suction fans, to the electrostatic filter and the scrubbing tower, not shown.

With conventional incinerating plants, the efficiency of the acid trapping reaction, which is reduced and to some extent unpredictable, requires that basic substances be used in much larger amounts than those required for neutralizing the flue gases, based on stoichiometric ratii, and practically makes any control systems ineffective and unusable.

With the incinerating arrangement of this invention, on the other hand, the high efficiency of the killing reaction enables the discharge of basic substances to be metered to suit the degree of acidity of the flue gases, specifically their HCl contents.

As schematically illustrated in FIG. 3, in accordance with this further inventive aspect, a probe 32 placed in the post-combustion chamber, preferably upstream of the burner 12, continuously samples the flue gas and sends the sample over a cooling element 33 to a conventional continuous analyzer 34, which will output a signal indicating the concentration of HCl and any other acid substances.

A suction fan 35 ensures the right flow rate of sample flue gas to the analyzer.

The output signal from the analyzer 34 is received by a control unit 36 which will modulate the flow rate of basic substances being blown or injected into the burner by acting on the motor 19 according to the acid level detected in the flue gas and possibly its flow rate if a varying one.

Thus, an effective control system can be realized which provides a particularly prompt response.

While in the above description reference has been made to waste disposal plants, the invention may also be applied to thermoelectric power plants, and more generally, to heat-generating plants.

Figure 4:
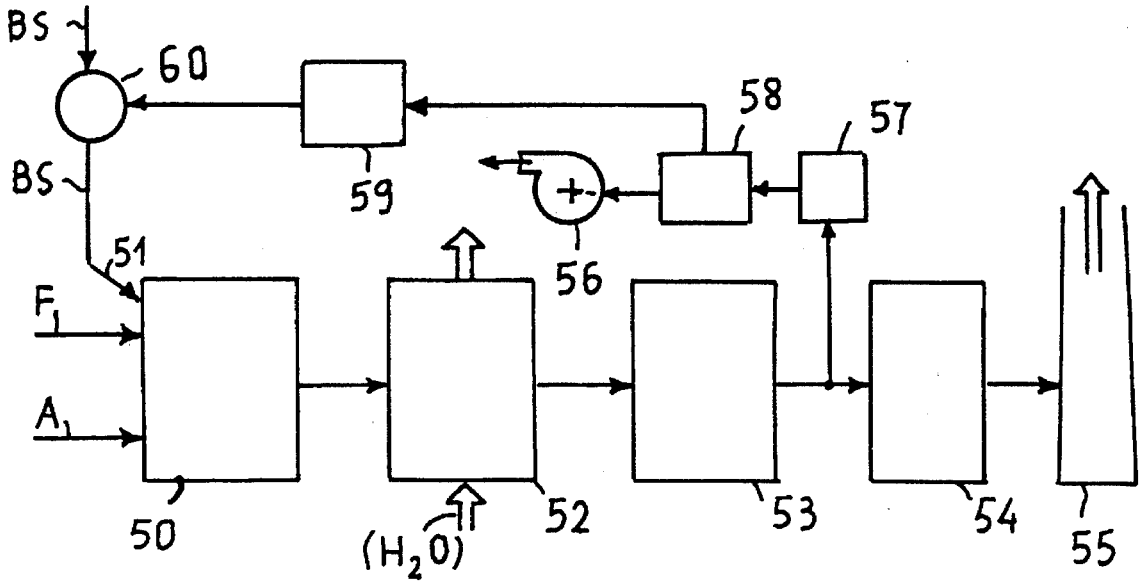
FIG. 4 shows schematically, in block diagram form, a thermal plant with an arrangement for hot killing the acid contents of flue gases according to this invention.

FIG. 4 shows schematically a thermoelectric power plant which utilizes the arrangement of this invention.

A (solid or liquid, such as coal, lignite, fuel oil) fuel F and combustion supporter A (air) are discharged at a suitable ratio to a combustion chamber 50 to produce a flame.

Through a diffuser/injector 51 which may be integrated to one of the fuel/combustion supporter discharge nozzles, a basic substance BS is additivated to the flame to neutralize any acidity of the flue gas right from the combustion stage.

The hot flue gas is flowed through a regenerative boiler 52 to transfer its heat contents to an exchange fluid, and then passed through a set of filters 53 and a scrubbing tower 54 to eventually be exhausted to the atmosphere via a chimney 55.

In thermoelectric power plants, the acidity of the flue gas is tied to the fuel being burned (essentially to its sulphur contents), whose characteristics are generally known before-hand and are liable to change very slowly over time as dictated basically by variations between lots of fuel deliveries.

Thus, the flue gas acidity trapping will require no control loop and may be accomplished with good approximation by metering the flow rate of basic substances to suit the sulphur content of the fuel as declared by the supplier.

A strict control may also be applied by means of a control loop which would pick up a sample of the flue gas downstream from the filters 53 (with a suction fan 56), and analyze it after it is cooled through a cooler 57, using an analyzer 58 to determine the flue gas acidity.

The acidity indication is used by a regulator 59 which controls modulation members 60 to change the flow rate of basic substances and provide proper neutralization of the acidity of the exiting flue gas. In this case, the regulated variable would be the residual acidity of the flue gas.

The response speed and gain of the system may be conveniently set to avoid instability of the control loop.

Figure 5:
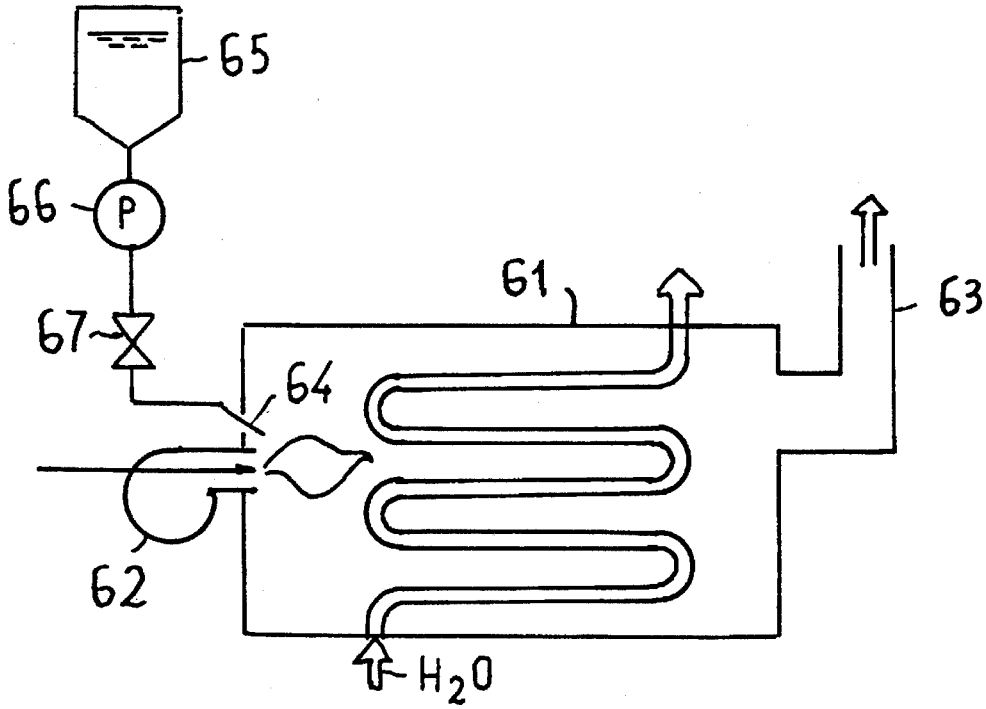
FIG. 5 shows schematically a heat-generating plant equipped with an arrangement for hot trapping the acid contents of flue gases according to this invention.

FIG. 5 shows schematically a heating system for dwelling spaces of the kind employed in schools, hospitals, condominia, etc.

In this case, the system is reduced basically to a boiler 61 provided with a burner 62 which discharges fuel and combustion supporter to a combustion chamber formed within the body of the boiler.

The flue gas leaving the boiler is exhausted directly to the atmosphere through a chimney 63.

The hot killing arrangement for the flue gas acidity, forming the subject-matter of the invention, may be applied in a simplified form to these systems as well, using no feedback control loops, thereby contributing to alleviate if not fully solve the serious pollution problems with which cities are confronted in wintertime.

To that aim, it will suffice to modify the burner device with the provision of an additional injection nozzle 64 for injecting basic substance, which substance is preferably, for reasons of simplicity and cost of the system, a basic substance in solution as sodium carbonate or bicarbonate supplied from a reservoir 65 by means of a pump 66.

Depending on the sulphur content of the fuel available, which may be that specified by the supplier upon delivery, a valve 67 can be set to control the outflow of basic substance.

It will be appreciated that in this case the pump 66 may be linked operatively to the operation of the burner 62, which may be a modulating, linear, or on/off mode.

Finally, it should be mentioned that many industrial processes release process gases from their various processing or production steps whose acidity should be controlled to either enhance the process efficiency or qualify them for discharge to the atmosphere.

With many of these processes, conventional methods for trapping the gas acidity by scrubbing with basic waters may be advantagously replaced with a hot trapping method to be implemented by mixing the gases with a secondary gas generated by combustion, with local generation of a flame in a combustion chamber, the secondary gas being enriched with basic substances additivated to the flame and activated thereby.

In case of incinerating or thermoelectric power plants having very large combustion/post combustion chambers, the efficiency of the acidity killing process may be further enhanced by the use of one or more combustors operating at very high temperature.

Figure 6:
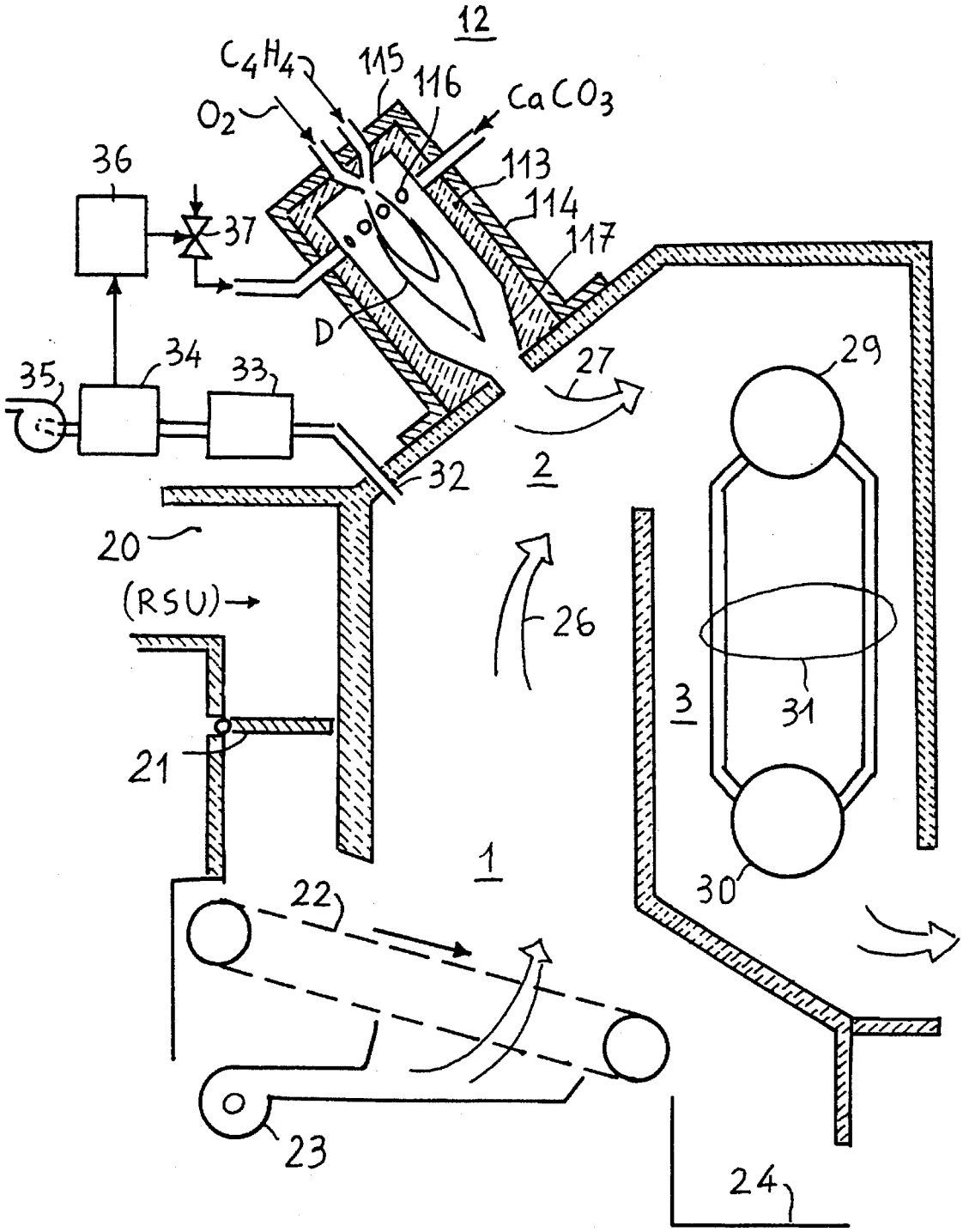
FIG. 6 shows schematically a cross section through an incinerating furnace for the the plant of FIG. 2, equipped with a very high temperature basic combustor forming a flame confining chamber.

One of such combustors is shown in FIG. 6 which depicts an incinerating furnace identical to the one shown in FIG. 3. In FIG. 6 the elements functionally equivalent to those of FIG. 3 are referenced by the same numerals.

Unlike the burner of FIG .3, the combustor 12 of FIG. 6 comprises a cylindrical chamber 113, made of a refractory material, which is enclosed within a liner or cage of metal 114 providing mechanical support and is fed at one end 115 from oxygen-delivering nozzles and nozzles delivering such high heat-value fuels as methane gas, Diesel oil, or else (mixtures of light hydrocarbons such as "tetrene").

The combustion ensures development of a flame D having a high temperature of up to 3000° C.

Provided on the end 115 of the cylindrical chamber, near the oxygen and fuel delivery nozzles, are a set of radial openings or nozzles 116 through which the chamber 113 is injected a powdered basic substance, preferably but not solely CaC03, MgC03, CaMg(C03)2, which is conveyed into the flame D.

The high temperature of the flame causes the mineral powder to decompose and become vaporized, with a high degree of ionic dissociation and formation of the so-called "plasma".

The mineral compounds, which are readily available from natural sources, are introduced, ground, and powdered, with no need for further treatment, into the combustor by means of injectors, not shown.

The combustion chamber 113 is terminated with a convergent accelerating nozzle 117 which discharges into the post-combustion chamber 2.

Under the combined actions of the nozzle 117 and the oxygen, fuel and basic substance delivery pressure, the chamber 113 is conveniently over-pressurized (e.g., at 0.1 kg/cm2) relative to the pressure prevailing within the post-combustion chamber.

The stream of high-temperature (above 2000° C.) gas transferred to the chamber 2 from the chamber 113 through the nozzle is then accelerated into a high-velocity jet which penetrates deeply into the waste flue gas and is uniformly blended therewith by turbulent motion which affects the whole volume of the post combustion chamber.

It should be noted that no like effect may be achieved directly with the flame, because the propagation rate of the flame, if separation and extinction thereof is to be avoided, imposes a limitation on the flame initial velocity and length.

We claim:

1. An arrangement for hot killing the acid contents of flue gas comprising:

a combustion chamber having at least one burner for generating burnt gas from the reaction of a fuel and a combustion supporter, with the production of a flame, means for discharging a basic substance to said chamber and into said burnt gas, said burnt gas enriched with said basic substance becoming mixed with flue gas and neutralizing acid contents of said flue gas, and a probe for sampling said flue gas and including an acidity meter in communication with a control device for modulating the flow rate of said basic substance, to enrich said burnt gas in accordance with a measured acidity from said acidity meter.

2. An arrangement as in claim 1, wherein said sampling probe is located upstream of said at least one burner.

3. An arrangement as in claim 1, wherein said at least one burner comprises:

a flame confining chamber means for discharging fuel, combustion supporting gas and a powdered basic substance in said flame confining chamber, said flame confining chamber having a convergent nozzle accelerating and inputing said burnt gas into said combustion chamber.

* * * * *